US005533674A

United States Patent [19]

Feyrer et al.

[11] Patent Number: 5,533,674

[45] Date of Patent: Jul. 9, 1996

[54] DRYING NOZZLE

[75] Inventors: Wolfgang Feyrer, Herzogenrath; Ewald Schmon, Metzingen, both of Germany

[73] Assignee: Herberts GmbH, Wuppertal, Germany

[21] Appl. No.: 269,108

[22] Filed: Jun. 30, 1994

[30] Foreign Application Priority Data

Jul. 1, 1993 [DE] Germany ..... 43 21 940.3

[51] Int. Cl.[6] ..... B05B 1/28

[52] U.S. Cl. ..... 239/288.5; 239/290; 239/291

[58] Field of Search ..... 239/290, 294, 239/288.5, 291, 311, 415, 419.5, 422, 428.5

[56] References Cited

U.S. PATENT DOCUMENTS

| | | | |
|---|---|---|---|
| 2,052,362 | 8/1936 | Roselund | 239/415 |
| 2,086,183 | 7/1937 | Gellner et al. | 239/415 |
| 2,880,940 | 4/1959 | Briggs | 239/415 |
| 3,599,876 | 8/1971 | Kyburg | 239/291 |
| 3,952,955 | 4/1976 | Clements | 239/288.5 |
| 4,181,261 | 1/1980 | Crum | 239/288.5 |
| 4,239,157 | 12/1980 | Fasth | 239/288.5 |
| 4,349,153 | 9/1982 | Johnson | 239/428.5 |
| 4,637,551 | 1/1987 | Seeger, Jr. et al. | 239/288.5 |
| 4,993,642 | 1/1991 | Hufgard | 239/290 |
| 5,322,221 | 6/1994 | Anderson | 239/291 |

*Primary Examiner*—Andres Kashnikow
*Assistant Examiner*—Lisa Douglas
*Attorney, Agent, or Firm*—Antonelli, Terry, Stout & Kraus

[57] ABSTRACT

A drying nozzle is comprised of a tube for mounting on a nozzle head of a spray gun. The body contains inlet slits for ambient air entering one tube end which taper in a direction of the interior of the tube. The body expands toward the other tube end. Upon mounting the body on the nozzle head the narrowest region of the tube between the tapering region of the inlet slits and the expanding region of the tube lies directly behind an air outlet opening when seen in direction of flow of the air passing out of the air outlet opening of the nozzle head. Upon supplying compressed air in the center of the tubular body a negative pressure in the tube interior is produced and as a result of which ambient air is drawn into one tube end and passes out at the other tube end together with the compressed air.

18 Claims, 4 Drawing Sheets

DRYING NOZZLE

FIELD OF THE INVENTION

This invention relates to a compressed air drying nozzle.

BACKGROUND TO THE INVENTION

A known type of compressed air drying nozzle consists of a tubular body which has an annular slot on the inside via which compressed air is admitted. This compressed air flows along the wall of the tubular body and thereby produces a negative pressure, as a result of which ambient air is drawn in by a tube end which, together with the compressed air, passes out of the other tube end. The compressed air is admitted via a compressed-air line of the drying nozzle.

Organic solvent-containing lacquers can be forcibly dried with this drying nozzle. By using the drying nozzle, the drying time is clearly reduced, as a result of which spray booth run-through time is shortened.

A drying nozzle of this type is especially useful for drying water-dilutable lacquers which, due to the physical properties of water, dry substantially slower than solvent-containing lacquers. The drying speed of such lacquers depends very heavily on the humidity of the ambient air. The higher the humidity, the lower the drying speed. The increase in drying time has a detrimental effect on the use of water-dilutable lacquers, since spray booths, drying chambers or drying ovens are blocked for a relatively long time.

In order to reduce the drying time, it is known to blow dried air onto the coated object with the aforementioned drying nozzle. Drying nozzles of this type are attached either to the ceiling or fastened to a stand. It is also known to make them in the form of guns which can be manually operated. Guns of this type are used primarily for drying smaller surfaces.

The disadvantage of this known embodiment is the requirement for excessive capital expenditure.

In order to avoid the additional capital expenditure, it is known to dry smaller surfaces in particular with a paint spray gun, whereby a trigger guard is pulled only to the extent that only air but no coating materials flow through the spray nozzle. The air jet is greatly limited and has a high velocity of flow, as a result of which defects can occur in the lacquer film. In addition, due to the very limited air jet, the blown surface is too small in order to be able to economically dry larger surfaces.

U.S. Pat. No. 2,086,183 discloses a paint spray gun in which the nozzle head has a protective nozzle which has a rear circular-cylindrical section which expands conically in the direction of flow of the paint/air jet mixture. Three segmental air nozzles are provided about the paint/air nozzles and are set back from these in the area of the circular-cylindrical section of the protective nozzle, the air nozzles being directed toward a conically expanding neck on the nozzle head. The purpose of this arrangement is to surround the fanning paint/air jet by means of an air veil passing out of the segmental air nozzles in order to reduce a mist formation. In this case, ambient air is drawn in via the annular slot between the cylindrical section of the protective nozzle and the nozzle head, but only to a slight extent since the segmental air nozzles are arranged in the area of the circular-cylindrical section of the protective nozzle and the paint nozzle and the air nozzle in the conically expanding area of the protective nozzle. The purpose of this arrangement is to surround the fanning paint/air jet by means of an air veil passing out of the segmental air nozzles in order to obtain a sharply limited paint/air jet and thus reduce the formation of mist.

SUMMARY OF THE INVENTION

It is an object of the present invention to construct the drying nozzle in such a way that the coated surface can be dried by means of a paint spray gun in which a gentle air jet is to be formed without sharp restriction.

Another object of the invention is the use of the noted drawing nozzles for drying coating agents, in particular water-dilutable coating agents. In this case, a preferred area of application is in the painting of vehicles and vehicle parts, in particular repair paints for vehicles.

In accordance with the embodiment of the invention a drying nozzle is comprised of a tubular body (tube) for mounting on a nozzle head of a spray gun, the body containing inlet slits for ambient air entering one tube end which tapers, in a direction of the interior of the tube, the body expanding toward the other tube end. Upon mounting the body on the nozzle head the narrowest region of the tube between the tapering region of the inlet slits and the expanding region of the tube lie directly behind an air outlet opening when seen in direction of flow of the air passing out of the air outlet opening of the nozzle head, whereby upon supplying compressed air in the center of the tubular body a negative pressure in the tube interior is produced and as a result of which ambient air is drawn into one tube end and passes out of the other tube end together with the compressed air.

BRIEF INTRODUCTION TO THE DRAWINGS

An embodiment of the invention will be described in greater detail below with reference to the following drawings, in which.

DETAILED DESCRIPTION OF THE INVENTION

Figure 1:
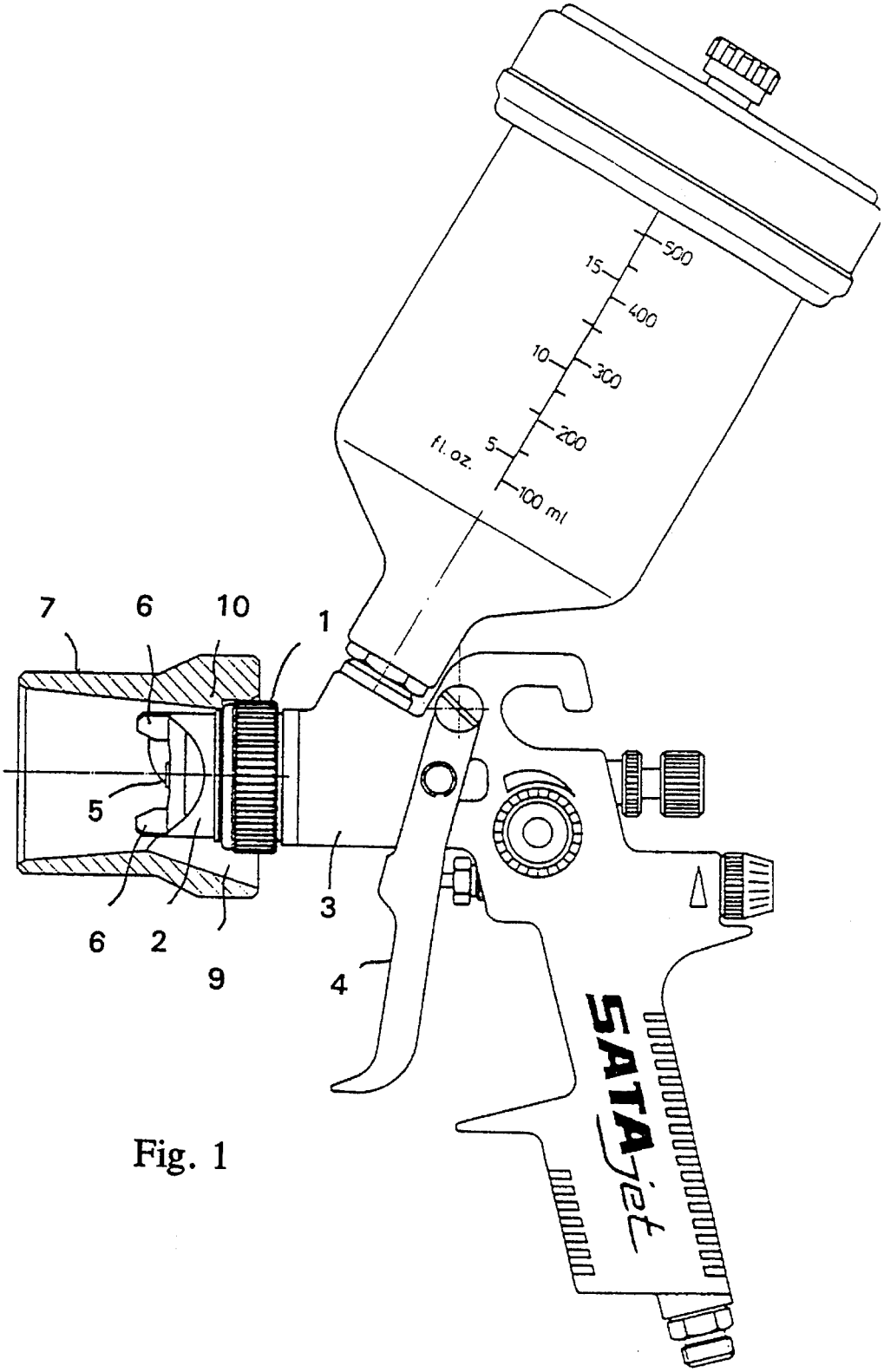
FIG. 1 is a side view of a paint spray gun with a mounted drying nozzle shown in section.
Figure 3:
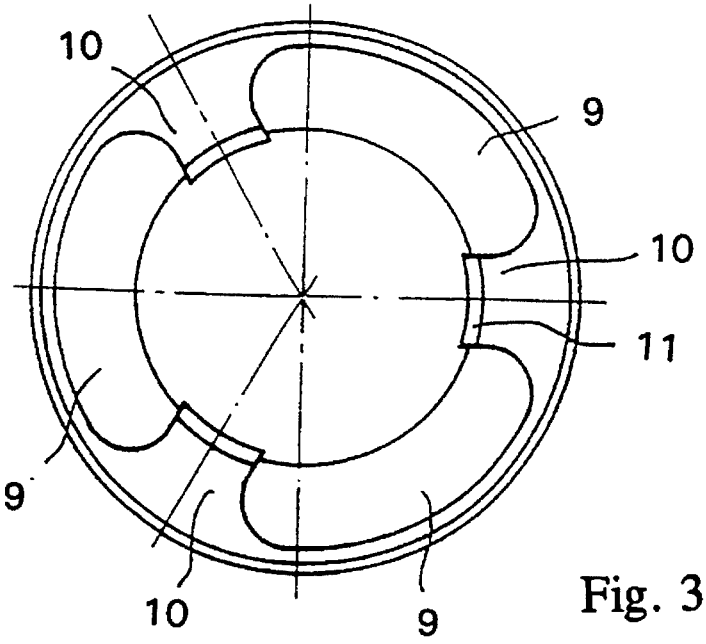
FIG. 3 is a view of the drying nozzle, seen in the direction of arrow III in FIG. 2.
Figure 2:
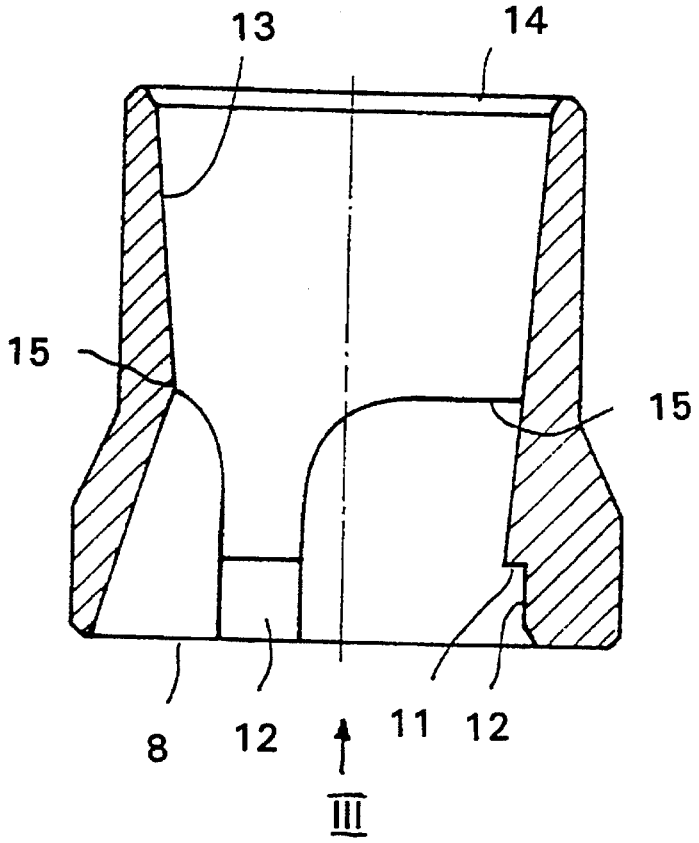
FIG. 2 is a section through the drying nozzle.

The paint spray gun of FIG. 1 has a nozzle head 2 which can be fastened to the gun body 3 via an edged screw cap 1. The paint spray gun has, in addition, a trigger guard 4 which can be brought into a first position in which only compressed air flows through the nozzle head 2.

In a second position, coating material flows out of the nozzle head together with the compressed air.

The nozzle head 2 has an omnidirectional nozzle 5 and, moreover, two points 6 which each have an air nozzle, by means of which the central coating material air jet can be deformed. The nozzle head is diagonally flattened between the points 6.

The drying nozzle 7 can be mounted on this nozzle head 2. This drying nozzle 7 is tubular in shape and has three inlet slits 9 on one tube end 8, the inlet slits 9 being separated from one another by flanges 10. Each flange 10 has a bearing shoulder 11 with which wall parts 12 form that extend to the one tube end 8. The drying nozzle 7 can be mounted on screw cap 1 via these wall parts 12, whereby the shoulders 11 come to lie against the screw cap 1 at the front. The inlet slits 9 taper in the direction of the tube interior. An inside wall 13, which expands in the direction of the other tube end 14, adjoins the tapering inlet slits 9. Flanges 10 have the shape of the inside wall 13 adjacent to shoulders 11. The expansion of the inside wall 13 is preferably between 3° and 10°.

The narrowest point 15 in the tube interior, i.e. the transition point between the tapering inlet slits 9 and the expanding inside wall 13, extends towards the omnidirectional nozzle 5, seen in the direction of the jet, and, in the case of the flat spray gun shown, preferably at the level between the omnidirectional nozzle 5 and the ends of points 6. This means that the omnidirectional nozzle 5 is located at a point before the inlet slits 9 pass over into the inside wall 13.

The inlet edges of the inlet slits 9 are preferably rounded at one tube end 8. The same is true for the outlet edge on the other tube end 14.

If the drying nozzle 7 is mounted on nozzle head 2, then trigger guard 4 is moved into the above mentioned first position, as a result of which compressed air is emitted from the omnidirectional nozzle 5 and, depending on the situation, out of the nozzles of points 6. This compressed air flows in the direction of the other tube end 14 and thereby produces a negative pressure which is greatest in the area of the narrowest point 15, as a result of which ambient air is drawn in via the inlet slits 9 and passes out with the compressed air at the other tube end 14. The air jet passing out at the other tube end 14 is gentle and without sharp definition. A great amount of ambient air is drawn in, whereby the ratio between ambient air and compressed air is approximately 15:1 to 10:1. In view of the fact that slits 9 taper inward, the flow of air is accelerated in the direction of the other tube end 14. As a result of the rounding at the inlet end of slits 9 and at the other tube end 14, air noises are considerably reduced. Despite points 6 and the flattening between the points, an almost uniform velocity distribution results over the cross-section of the air flow passing out the drying nozzle.

The gentle air jet thus produced can be directed toward objects coated with water dilutable coating substances. It produces uniform drying of the surface without generating faults in the lacquer film. This mode of operation is especially suitable for automobile repair painting.

The drying nozzle 7 can be used both in low-pressure and high-pressure guns as well as in omnidirectional guns without points 6. It can be produced either mechanically or by injection moulding out of light metals or plastics. By edging the screw cap 1, a secrete hold at the nozzle head 2 is assured.

Figure 5:
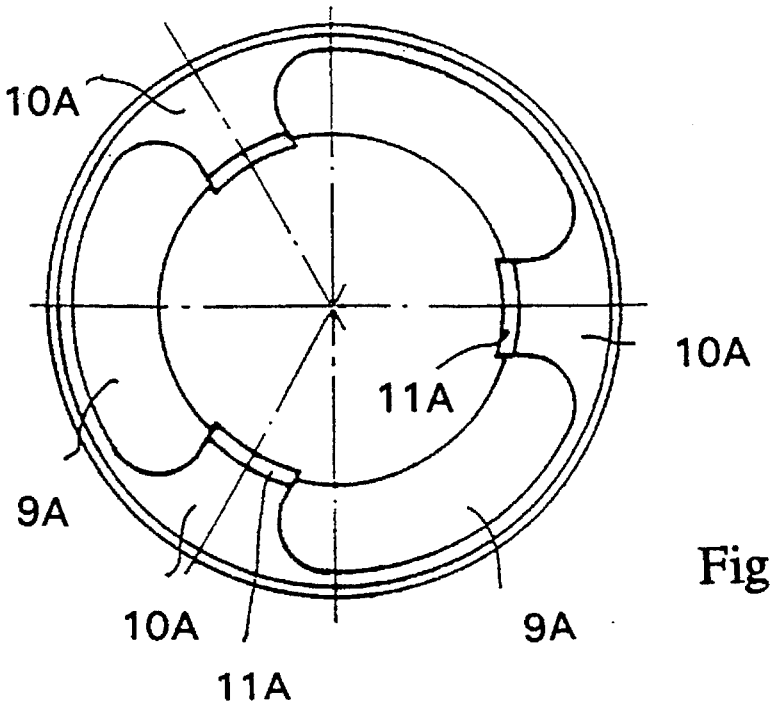
FIG. 5 is a view corresponding to FIG. 3 in the second embodiment.
Figure 4:
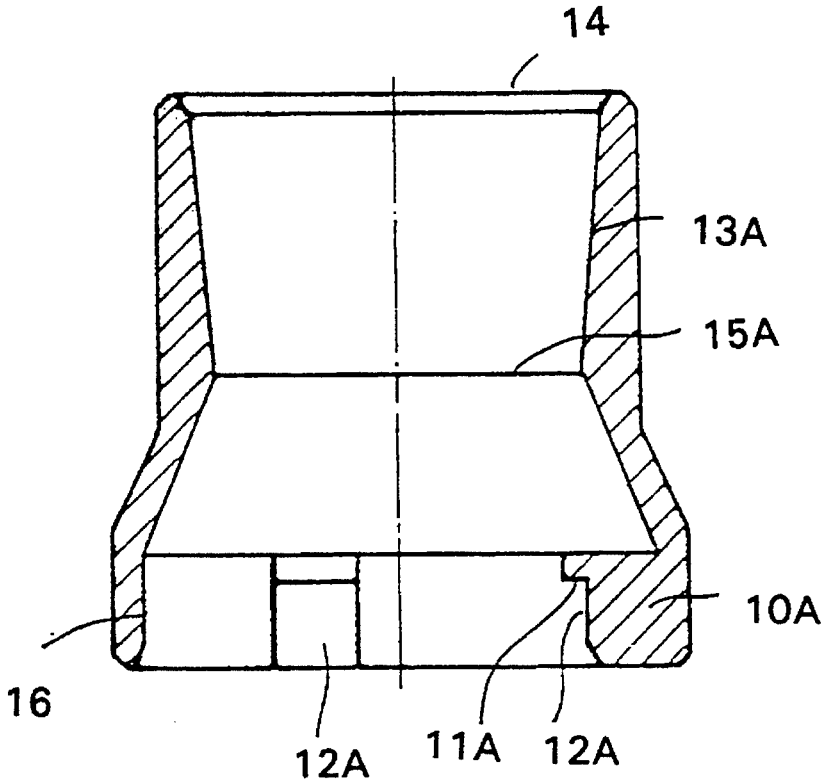
FIG. 4 is a section corresponding to FIG. 2 in a second embodiment.

In the embodiment shown in FIGS. 4 and 5, slits 9A are formed by a cylindrical wall part 16 from which flanges 10A proceed radially inward, which have wall parts 12A and shoulders 11A. The tapering region of slits 9A, which tapers inward and extends up to the narrowest point 15A, adjoins this cylindrical wall part 16. This tapering region is also present behind flanges 10A adjoining this cylindrical wall part 16. When the drying nozzle is mounted, the omnidirectional nozzle is located in the tapering region in front of the narrowest point 15A.

Figure 6:
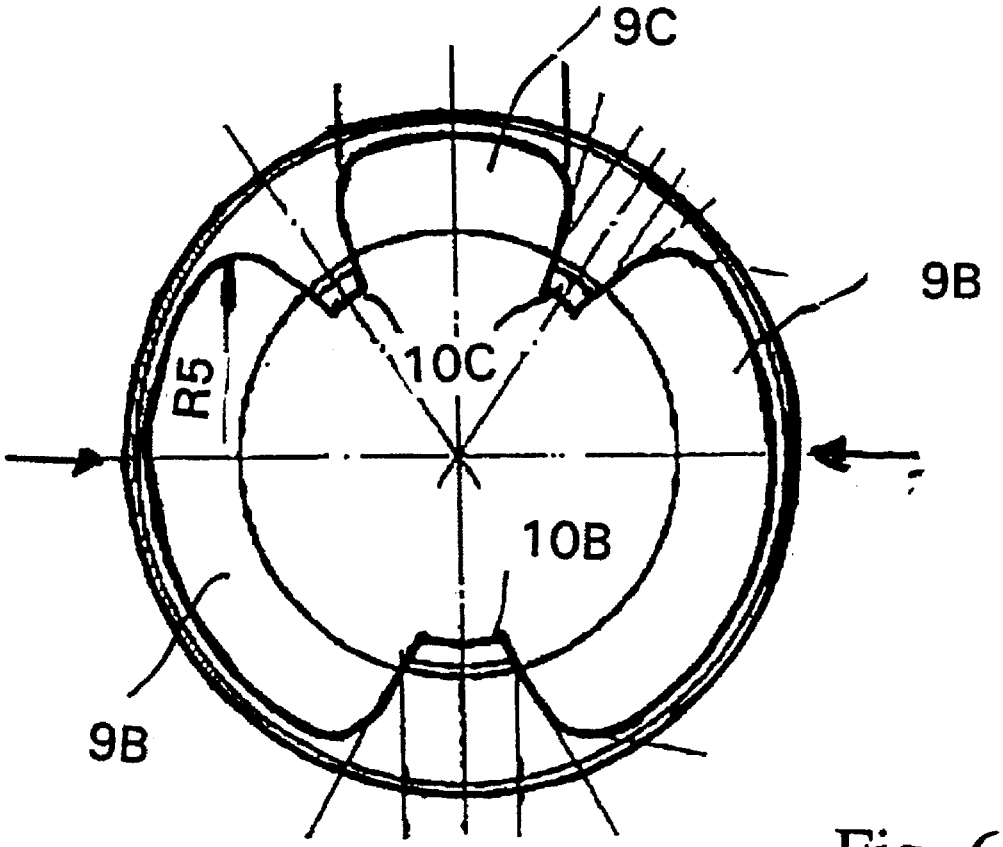
FIG. 6 is a view corresponding to FIG. 3 in a third embodiment.

A disadvantage can occur in the aforementioned embodiments should a sharp-edged edge of the screw cap 1 scrape on wall parts 12, 12A when the drying nozzle 7 is mounted, the material then being blown onto a coated surface which has to be dried. This is avoided in the embodiment shown in FIG. 6.

In this embodiment, there is a first flange 10B, opposite to which two additional flanges 10C are arranged. The angle range of the inlet slits 9B between 10B and adjacent flanges 10C is substantially larger in this case, preferably twice as large, than the angle range of the inlet slits 9C between the flanges 10C. Moreover, flanges 10C are each approximately half as wide as flange 10B.

If a finger is now pressed against the outside surface in the area of inlet slits 9B in the direction of the arrow when this drying nozzle is mounted, the elastic wall is deformed inward so that the distance between flange 10B and flanges 10C increases. As a result of this increase in distance, the drying nozzle can be easily mounted on the screw cap 1. In order to facilitate handling, markings can be provided on the aforementioned outside surface in the area of the arrow ends.

I claim:

1. A drying nozzle comprising a tube adapted to be mounted on a nozzle head of a spray gun, the tube containing inlet slits for ambient air entering one tube end which taper in a direction of the interior of the tube, the tube expanding toward the other tube end, upon mounting the tube on the nozzle head the narrowest region of the tube between the tapering region of the inlet slits and the expanding region of the tube lying directly behind an air outlet opening when seen in direction of flow of the air passing out of the air outlet opening of the nozzle head, whereby upon supplying compressed air in the center of the tubular body a negative pressure in the tube interior is produced and as a result of which ambient air is drawn into one tube end and passes out of the other tube end together with the compressed air.

2. A drying nozzle as defined in claim 1, wherein the tube expands toward the tube end by between about 3° and 10°.

3. A drying nozzle as defined in claim 1, the nozzle head having points, a narrowest point lying between an omnidirectional nozzle and the point ends.

4. A drying nozzle as defined in claim 1, further including flanges extending between the inlet slits each having a contact shoulder for setting against the nozzle head.

5. A drying nozzle as defined in claim 4, the flanges having a shape following the expanding area of the tube.

6. A drying nozzle as defined in claim 5, the flanges extending radially inward from the cylindrical wall part.

7. A drying nozzle as defined in claim 4, the flanges being comprised of a first flange and two additional flanges disposed opposite to the first flange, an angle range of one inlet slit located between the first flange and the adjacent additional flanges being substantially larger than the angle range of another inlet slit located between said additional flanges, the wall in the region of said one inlet slit being easily elastically deformable.

8. A drying nozzle as defined in claim 1, the inlet edges of the inlet slits being rounded.

9. A drying nozzle as defined in claim 1, the outlet edge of said other tube end being rounded.

10. A drying nozzle as defined in claim 1, the slits being formed by a cylindrical wall part at one tube end and an area adjacent thereto tapering inward.

11. A drying nozzle as defined in claim 10, the inwardly tapering region adjoining the cylindrical wall part extending over the entire periphery of the tube.

12. A method for drying substances coated, by means of a paint spray gun, comprising mounting a drying nozzle as defined in claim 1 on a spray nozzles of a paint spray gun, pulling a trigger guard to an extent such that only air but no coating agent flows through the spray nozzle and applying a gentle jet of air passing out of the spray nozzle to a surface to be dried.

13. A method as defined in claim 12 in which the surface is coated by a coating substance.

14. A method as defined in claim 13 in which the coating substance is water dilutable.

15. A method as defined in claim 12 in which the surface is a portion of a vehicle.

16. A method of drying coating substances comprising applying a gentle jet of air to a coating substance emitted from a drying nozzle as defined in claim 1.

17. A method as defined in claim 16 in which the coating substance is water dilutable.

18. A method as defined in claim 16 in which the coating substance to be dried is on the surface of a vehicle.

* * * * *